US012181243B1

(12) United States Patent
Lipinski et al.

(10) Patent No.: US 12,181,243 B1
(45) Date of Patent: Dec. 31, 2024

(54) SIDE-MOUNTED FORWARD CHARGING SYSTEM FOR A FIREARM

(71) Applicants: Daniel A. Lipinski, Bunnell, FL (US); Todd A. Gomez, Palm Coast, FL (US)

(72) Inventors: Daniel A. Lipinski, Bunnell, FL (US); Todd A. Gomez, Palm Coast, FL (US)

( * ) Notice: Subject to any disclaimer, the term of this patent is extended or adjusted under 35 U.S.C. 154(b) by 0 days.

(21) Appl. No.: 18/487,045

(22) Filed: Oct. 14, 2023

(51) Int. Cl.
*F41A 5/08* (2006.01)
*F41A 21/44* (2006.01)

(52) U.S. Cl.
CPC ..... *F41A 5/08* (2013.01); *F41A 21/44* (2013.01)

(58) Field of Classification Search
CPC ..... F41A 3/72; F41A 5/08; F41A 21/44
USPC ..... 42/90; 89/1.4
See application file for complete search history.

(56) References Cited

U.S. PATENT DOCUMENTS 8,307,747 B2 * 11/2012 Fitzpatrick ..... F41A 9/38 89/1.4
9,347,737 B2 * 5/2016 Troy ..... F41C 7/02
10,598,451 B1 * 3/2020 Haidu ..... F41A 3/72
2010/0000396 A1 * 1/2010 Brown ..... F41A 3/72 89/1.4
2017/0176119 A1 * 6/2017 Cross ..... F41A 3/66
2018/0142975 A1 * 5/2018 Hoon ..... F41A 3/66
2018/0195820 A1 * 7/2018 Noonan ..... F41C 23/16
2019/0154382 A1 * 5/2019 Pizano ..... F41A 19/47
2020/0080802 A1 * 3/2020 Jennings ..... F41A 3/72
2022/0146219 A1 * 5/2022 Noonan ..... F41A 5/18
2022/0170708 A1 * 6/2022 Knöpfle ..... F41A 35/06
2022/0178632 A1 * 6/2022 Lee ..... F41A 3/72
2023/0272989 A1 * 8/2023 McMinn ..... F41A 3/94 89/191.01

* cited by examiner

*Primary Examiner* — Joshua E Freeman
*Assistant Examiner* — Benjamin S Gomberg
(74) *Attorney, Agent, or Firm* — The Law Office John R. Nelson, PA; John R. Nelson, esq.

(57) ABSTRACT

Disclosed is a side-mounted forward charging system for a firearm. The side-mounted forward charging system for a firearm is designed to be a simple and immediate upgrade to various firearms, for example, pistol-caliber AR platform rifles. The side-mounted forward charging system for a firearm includes the following components: a handguard, a barrel nut, a forward retention unit, a charging catch, a charging rod, and a charging handle. The side-mounted forward charging system for a firearm works without any additional proprietary components. The side-mounted forward charging system for a firearm allows a user to charge a firearm with a user's left or right hand while maintaining a horizontal position aimed at a target. The side-mounted forward charging system for a firearm gives a safety advantage to a user, allows for more accurate and quicker targeting while charging, and provides for overall efficiency while operating the firearm.

9 Claims, 12 Drawing Sheets

SECTION A-A

SIDE-MOUNTED FORWARD CHARGING SYSTEM FOR A FIREARM

BACKGROUND

Field of Invention. This invention relates to firearms, particularly a firearm charging system to replace the existing firearm charging system.

The following discussion is not to be deemed admitted prior art but merely related art to show possible background and information related to firearm charging systems.

A firearm charging system is a mechanism used to prepare the weapon for firing by loading a cartridge into the firing chamber and cocking the firearm's internal components, such as the hammer or striker, in preparation for discharge. The specific type of charging system can vary depending on the firearm's design, but its primary purpose is to make the weapon ready to fire.

The type of charging system a firearm uses can significantly affect its operation, rate of fire, and ease of use. The system choice depends on the firearm's intended purpose and design considerations.

A pistol-caliber AR-15 platform is built on the AR-15 rifle platform but chambered for pistol cartridges instead of rifle cartridges. In other words, it looks and operates like an AR-15 but fires smaller, handgun-caliber ammunition.

Many firearms include rear charging systems (e.g., the AR-15 and M16 platforms), which do not have a gas-operated system. The lack of a gas-operated system is most common in pistol caliber AR-15 platforms that operate in an open bolt or blow-back system, utilizing only the recoil from the cartridge pressure to cycle the firearm. Without a gas system, this leaves an opening in the front of the upper receiver where a gas tube would traditionally pass through.

Operating the firearm with a rear charging system requires the following steps: (1) the user removes the firearm from their shoulder, thus breaking their firing sightline; (2) the user locates the rear charging handle on the firearm, and depending on the specific design, it may be located at the rear of the upper receiver, above the stock or buffer tube, or elsewhere on the firearm's rear; (3) the user grasps the rear charging handle and pulls it rearward (toward the stock or buffer tube) until it stops or resistance is felt; (4) the user allows the charging handle to move forward under spring tension which will chamber a round from the magazine if one is present, the firearm will be in a "cocked" position, ready to fire once the safety is disengaged and the trigger is pulled.

Having to remove the firearm from a shooting position causes inefficiencies when attempting to fire on a target.

Therefore, a need exists for a side-mounted forward charging system for a firearm that can be installed on an existing rear charging system firearm.

BRIEF SUMMARY OF THE INVENTION

This invention relates generally to, but is not limited to, a side-mounted forward charging system for a firearm.

Disclosed are numerous aspects of a side-mounted forward charging system for a firearm.

It is desirable to have a side-mounted forward charging system for a firearm for installation by a user on an existing firearm. Furthermore, it is desirable to have a side-mounted forward charging system for a firearm that uses the existing firearm components like upper receivers, bolt carriers, and recoil systems. Furthermore, it is desirable to have a side-mounted forward charging system for a firearm that is less expensive than other systems.

The disclosed device advantageously fills these needs and addresses the aforementioned deficiencies by providing a side-mounted forward charging system for a firearm.

In general, the embodiments provided herein relate to a side-mounted forward charging system for a firearm. The system includes a handguard 001 that houses a forward charging rod. The forward charging rod includes a minor diameter that engages with the charging catch. A barrel nut is threaded over an upper receiver to tighten a barrel in a suitable position; the side-mounted forward charging system permits the conversion of a non-gas operated firearm to a side-mounted forward charging firearm.

These embodiments function with off-the-shelf standard AR and M-16 style parts. Unlike other systems that require proprietary upper receivers, bolt carriers, and recoil systems, this invention allows users to upgrade an existing complete rifle or build a rifle utilizing widely available and substantially less expensive parts. The side-mounted forward charging system for a firearm also allows the end user to customize the platform using a vast selection of standard components for their specific application that would not be an option with prior existing technology due to the need to use proprietary components.

The rotational bolt lock allows for the bolt to be locked back using the forward charging system and is not available in any prior existing technology for an AR/M-16 platform and therefore is advantageous because it allows single-handed bolt locking and unlocking, and the "Slap Bolt" unlocking is a desirable and sought-after unlocking function in the firearms industry.

BRIEF DESCRIPTION OF THE DRAWINGS

A side-mounted forward charging system for a firearm is illustrated by way of example, and not by way of limitation, in the figures of the accompanying drawings.

While aspects of a side-mounted forward charging system for a firearm will be described with reference to the details of the embodiments of the invention shown in the drawings (and some embodiments not shown in the drawings), these details are not intended to limit the scope of the invention.

LIST OF FIGURE ITEMS

Figure 1:
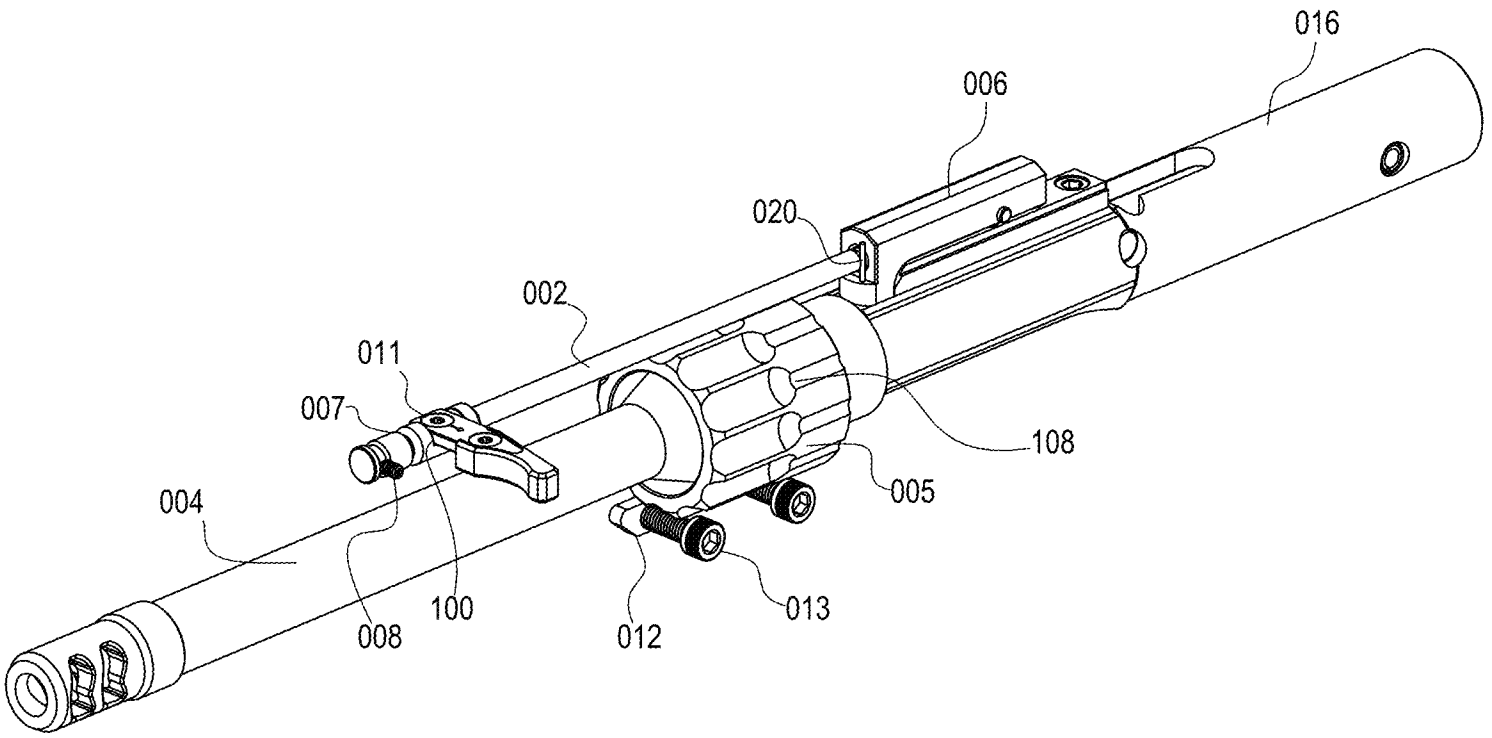
FIG. 1. illustrates a left side perspective view of the side mounted forward charging system components and additionally including the bolt carrier and barrel.

001 A handguard
002 A charging rod
003 An upper receiver
004 A barrel
005 A barrel nut
006 A charging catch
007 A magnetic catch housing
008 A magnetic catch retainer screw
009 A magnetic catch magnet
010 A charging handle mount plate
011 A flat head screw
012 A clamp plate nut
013 A clamp screw
014 A charging handle knob
015 A gas key
016 A bolt carrier
017 A lower receiver
018 A magazine release
019 A 9 mm bullet
020 A charging catch retainer
021 A grip
022 A charging handle plug
023 A front takedown pin
024 A rear takedown pin
100 A charging rod slot
101 A charging handle slot
102 A charging catch bore
103 A charging rod groove
104 A retention notch
107 A cylindrical bearing guide
108 A barrel nut groove
109 A mount plate expansion slot
110 A charging rod threaded hole
113 A countersunk screw hole
114 A travel slot
115 A gas tube hole

DETAILED DESCRIPTION

The order of the steps of disclosed processes may be altered within the scope of the invention.

This disclosure will now provide a more detailed and specific description referring to the accompanying drawings. The drawings and specific descriptions of the drawings, as well as any specific or alternative embodiments discussed, are intended to be read in conjunction with the entirety of this disclosure. A side-mounted forward charging system for a firearm may, however, be embodied in many different forms and should not be construed as being limited to the embodiments set forth herein; rather, these embodiments are provided by way of illustration only and so that this disclosure will be thorough, complete and fully convey understanding to those skilled in the art.

The invention does not require that all the features and advantages need to be incorporated into every version of the invention.

Although preferred embodiments of the invention have been described in considerable detail, other versions and embodiments of the invention are certainly possible. Therefore, the present invention should not be limited to the described embodiments herein. All features disclosed in this specification including any claims, abstract, and drawings may be replaced by alternative features serving the same, equivalent or similar purpose unless expressly stated otherwise.

For the purposes of promoting an understanding of the principles of a side-mounted forward charging system for a firearm, reference will now be made to the embodiments illustrated in the drawings and specific language will be used to describe the same, only as examples and not intended to be limiting.

The terms "firearm", "AR platform", "AR-15 platform", and "M16 platform" may be used interchangeably herein.

In some embodiments of a side-mounted forward charging system for a firearm a firearm is typically a pistol-caliber AR platform rifle.

A "handguard 001 extrusion" is the raw material from which a handguard 001 is machined from.

A "handguard" as used here in is the actual finished component machined out of the "handguard extrusion."

A handguard extrusion in this invention is a unique designed profile that incorporates a cylindrical bearing guide 107 that houses a charging rod, which is differentially significant then other "handguard extrusions" that are used to manufacture other handguards.

A "forward retention unit" as used herein is a pressed together assembly of a magnetic catch housing 007, a magnetic catch magnet 009, held in place in the handguard by the magnetic catch retainer screw 008 in the cylindrical bearing guide 107.

Disclosed is a side-mounted forward charging system for a firearm, comprising the following components: (1) a handguard 001, (2) a charging rod 002, (3) a charging catch 006, (4) a barrel nut 005, (5) a forward retention unit.

These components generally speaking, are configured as follows: (1) a barrel nut 005 is threaded onto an upper receiver 003; (2) a charging rod 002 is inserted into a handguard 001; (3) a charging handle mount plate 010 with a charging handle knob 014 attached slides into a slot 100 in the charging rod 002; (4) the charging handle mount plate 010 is attached by a flat head screw 011; (5) the handguard 001 assembly slides over the barrel nut 005 while passing the charging rod 002 through the upper receiver 003 and clamp screws 013 are tightened to a clamp nut plate 012; (6) resulting in compressing the handguard 001 onto the barrel nut 005; (7) a charging catch 006 is then dropped into a charging handle slot 101 in the upper receiver 003 and pushed forward until the charging rod 002 slides into a bore 102 on the charging catch 006; (8) resulting in the charging catch retainer 020 securely clipping into a groove 103 on the charging rod 002.

The disclosed device and method for a side-mounted forward charging system for a firearm is unique when compared with other known apparatuses and solutions because it provides: (1) for converting non gas operated (blow back or open bolt) AR-15 and M16 platforms, usually found on pistol caliber firearms, to a side-mounted forward charging system; (2) for installation with off the shelf upper receivers, lower receivers, barrels, and bolt carriers; (3) in the rear position the handle can be tilted upward to engage a stop machined in the handguard 001 to hold the bolt open against the buffer spring tension. The charging handle can then be slapped down to release the catch and send the firearm into battery. The handguard 001 is designed in an ambidextrous fashion allowing the charging handle to be mounted in a left or right-handed orientation.

The disclosed device and method for a side-mounted forward charging system for a firearm is unique in that it is structurally different from other known apparatuses or solutions. More specifically, a side-mounted forward charging system for a firearm is unique due to the presence of (1) a proprietary handguard 001 extrusion profile with a built-in cylindrical bearing channel that guides a charging rod through the unused gas tube opening, where it locks into and engages a proprietary charging catch, which mimics the interaction of a standard rear charging handle (which this system replaces) with the bolt carrier to cycle the bolt carrier; (2) a side-mounted charging handle mounted to the charging rod and used to cycle the rod from the forward (closed bolt) position to the rearward (open bolt) position.

A handguard 001 is generally cylindrical with a barrel front open end and an attachment end.

A handguard 001 may be of a size, but not limited to, having a length of 12 cm to 41 cm (approximately 4.75 inches to 16.1 inches) and a diameter of 3.5 cm to 7 cm (approximately 1.5 inches to 2.75 inches).

A handguard 001 may be made of a material like, not meant to be limiting, aluminum, steel, plastic, carbon fiber.

In some embodiments, a handguard 001 is an aluminum extrusion profile which is then machined with additional functional and aesthetic features. The handguard 001 is mounted on the front of the firearm and surrounds the barrel 004 of the firearm. The handguard 001 provides a place to mount accessories as well as a place to hold the firearm, acting as a heat break. The handguard 001 is also the housing for the charging rod assembly 002. The handguard 001 mounts to the barrel nut 005 via an integral clamp by tightening the two clamp screws 013 into the clamp nut plate 012.

A charging rod 002 is a generally cylindrical object.

A charging rod 002 may be of a size, but not limited to, having a length of 10 cm to 25.5 cm (approximately 4 inches to 10 inches) and having a diameter of 4 mm to 13 mm (approximately 0.15 inches to 0.5 inches).

A charging rod 002 may be made of a material like, not meant to be limiting, aluminum, steel, metal alloys.

In some embodiments, the charging catch 006 replaces a rear charging handle.

In some embodiments, the charging catch 006 permits the forward charging rod to cycle a bolt without a user having to remove the firearm from their shoulder.

In some embodiments, the charging catch 006 is a metal component that replaces the standard rear charging handle on conventional rear charging platforms. The charging catch 006 is designed to interact with the bolt carrier 016 in the same way the original charging handle would, utilizing a catch that engages the top of the bolt carrier. The charging catch 006 has two cylindrical bosses that ride in the charging handle slots 101 of the upper receiver. The front of the charging catch 006 has a bore hole 102 that the charging rod 002 is inserted into until the charging catch retainer 020 engages in the V groove 103 of the charging rod 002.

In some embodiments, the system is designed to convert a non-gas operated traditional firearm to a firearm having a side-mounted forward charging system.

In some embodiments, the barrel nut 005 is a cylindrical metal nut that threads over the barrel nut threads of the upper receiver to tighten the barrel 004 in place.

In some embodiments, the barrel nut 005 is further comprised of a plurality of grooves to allow clearance of the forward charging rod.

In some embodiments, a charging assembly is housed within the handguard 001, the charging assembly provided in a cylindrical bearing guide 107 housed within the handguard extrusion.

In some embodiments, the forward charging rod 002 is configured to cycle the firearm.

In some embodiments, the forward charging rod 002 is further comprised of a charging handle mount plate 010 to mount the charging knob 014 to the charging rod 002.

In some embodiments, the forward charging rod 002 is further comprised of a charging handle knob 014 to permit the manipulation of the charging handle rod while charging the firearm.

In some embodiments, the forward charging rod is configured as a cylindrical rod including a major diameter and a minor diameter, wherein the major diameter travels through a bearing channel of the handguard 001 and wherein the minor diameter travels through a gas tube hole 115 of the upper receiver 003 and engages into the charging catch 006 and charging catch retainer 020 via the V shaped grove. A charging rod also has a slot 100 and a charging rod threaded hole 110 for mounting the charging handle mount plate 010 using the flat head screw 011.

In some embodiments, the charging handle mount plate 010 has two countersunk screw holes 113. One hole is intersected with a thin slot to allow the plate to expand inside the charging rod 100 slot when the screw is tightened to ensure a tight fit.

In some embodiments, a charging handle knob 014 is made of, but not limited to steel. The charging handle knob 014 mounts to the charging handle mount plate 010 to give an ergonomic place for a user's hand to cycle the firearm.

In some embodiments, the minor diameter is engaged with a charging catch 006 and a charging catch retainer 020 via a V-shaped groove.

In some embodiments, the charging rod 002 includes a slot 100 and a charging rod threaded hole 110 to mount the charging handle mount plate using a fastener.

In some embodiments, a proprietary handguard 001 houses a forward charging rod 002 that is passed through an open gas tube hole 115 to engage with a proprietary charging catch 006 that replaces the rear charging handle. The user can then cycle the bolt without removing the rifle from their shoulder and breaking their sightline, which is more ergonomic and comfortable to cycle the rifle in this fashion.

In some embodiments, the system replaces the standard rear charging handle charging system on a traditional AR-15/M-16 platform and similar clones with a forward side charging system. This replacement allows the operator to cycle the charging system without taking it out of the firing position to clear jams or cycle the bolt into the battery, making the platform more efficient and effective. The system also allows the user to lock the bolt back using only the forward charging handle by rotating it upwards at the rear of its travel into a retention notch. Then the user can easily "slap" the charging handle down and allow the charging system to move into the battery; additionally, it allows for a more straightforward gross motor skill function to operate the system by not having to use two hands to accomplish this task as the current platform requires. This system also utilizes a non-reciprocating charging handle, meaning the Charging Handle Knob stays locked in the forward position during normal firing.

In some embodiments, the handguard 001 allows the system to be configured in various lengths for specific firearm applications. Additionally, the outer portion of the handguard 001 is not critical to the system's function and could be modified for other functionalities or aesthetics as is known in the arts.

In some embodiments, the handguard 001 is mounted in the same standard fashion as many handguards with an internal clamp onto the barrel nut. One skilled in the arts will readily understand that various mounting options may be implemented.

In some embodiments, the charging handle knob may be constructed of various shapes, sizes, and materials and provided in an adjustable configuration to meet specific application needs.

In some embodiments, the charging catch retainer shape, size, material, and configuration may adjusted or changed.

Figure 2:
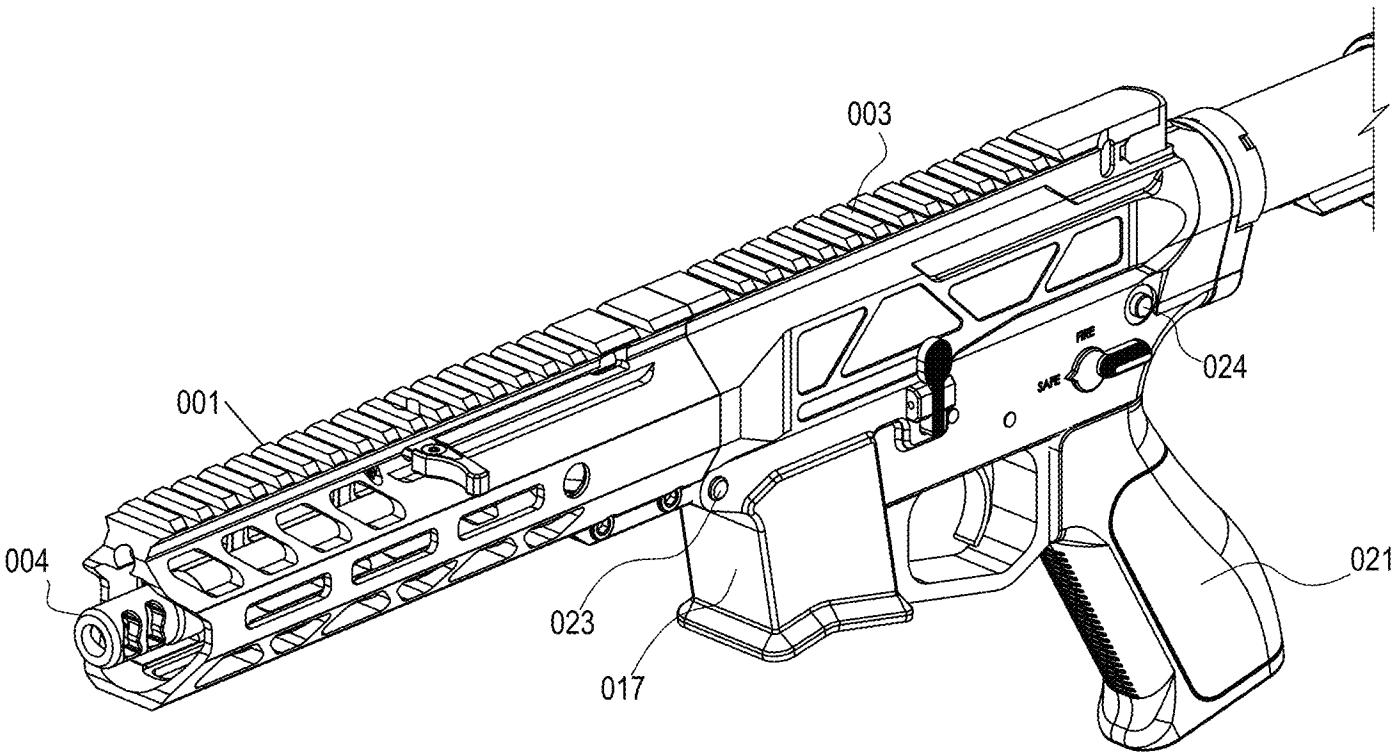
FIG. 2. illustrates a left side perspective view of the upper receiver and lower receiver including the handguard and charging handle knob in the bolt-forward closed position, the upper and lower receiver, pistol grip, and buffer tube according to some embodiments.
Figure 3:
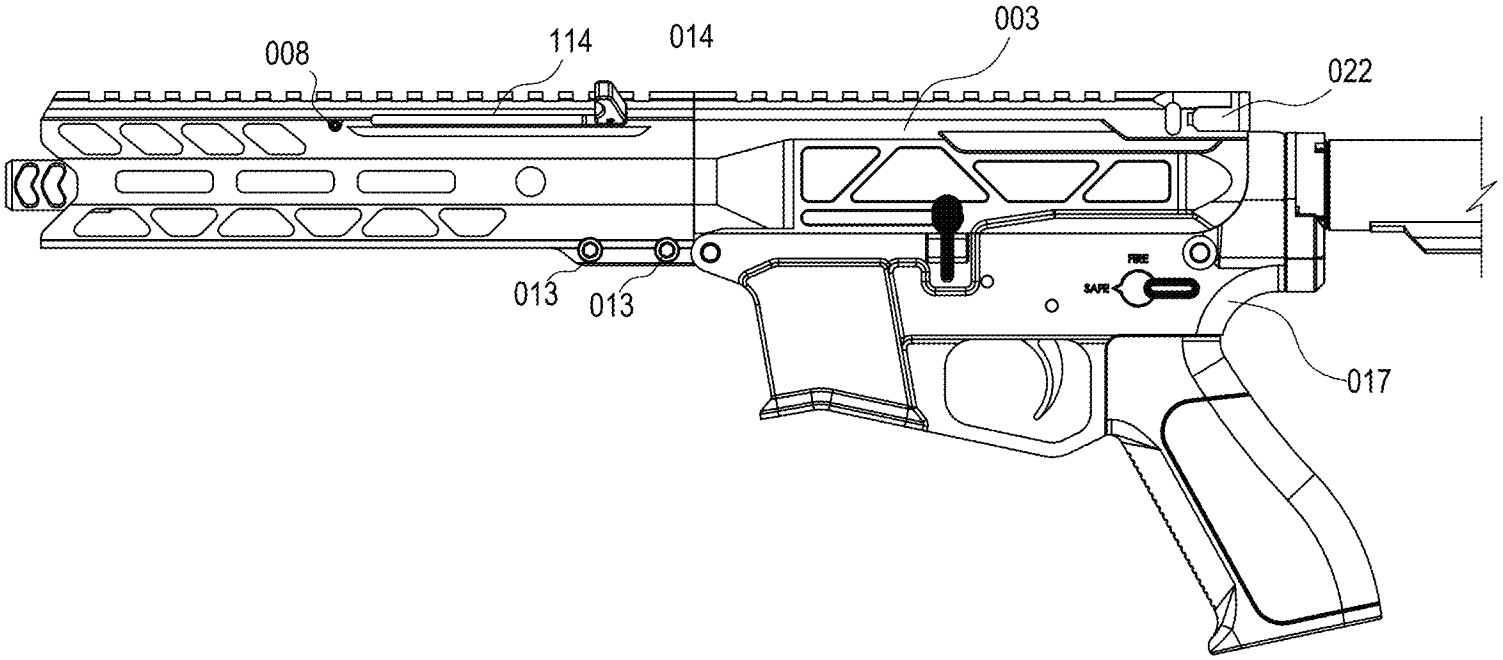
FIG. 3. illustrates a left side view of the side-mounted forward charging system shown in the rear, bolt open position, the upper and lower receiver, pistol grip, and buffer tube according to some embodiments.

In some embodiments, as illustrated in FIG. 1, and in FIG. 2 and FIG. 3, to cycle the firearm from the bolt closed position, the user grasps the charging handle knob 014 and draws it toward the rear of the firearm. This causes the charging handle mount plate 010 to pull the charging rod 002 rearward through the cylindrical guide in the handguard 001. The charging rod 002 pushes the charging catch 006 toward the rear of the firearm. As the charging catch 006 moves rearwards, it engages on a bolt carrier 016 and begins to move it to the rear of the firearm and opening the breech.

Figure 4:
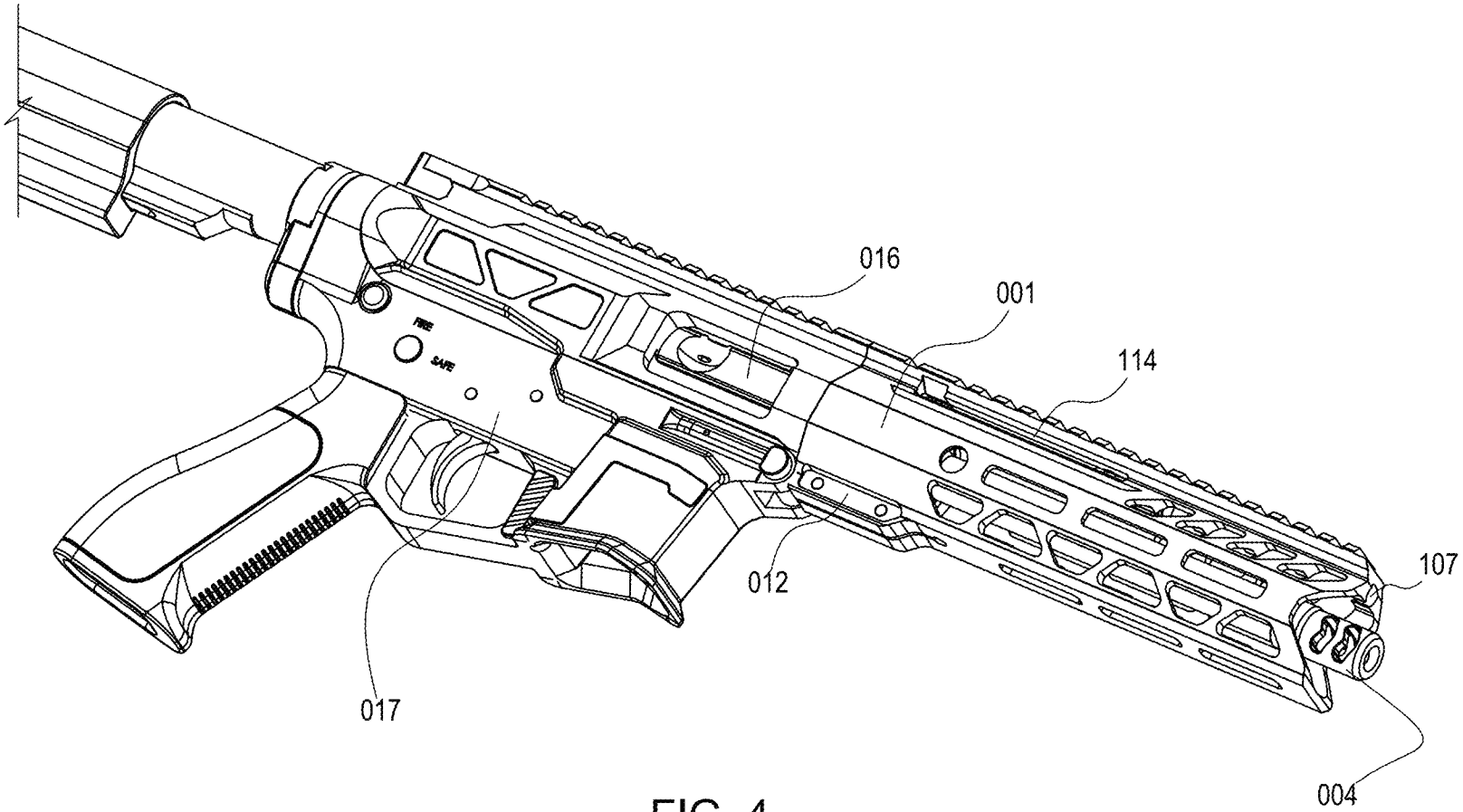
FIG. 4. illustrates a right side perspective view of the upper receiver and lower receiver according to some embodiments.

FIG. 4. illustrates a right side perspective view of the upper receiver and lower receiver according to some embodiments. Shows the clamp nut plate 012, which the clamp screws 013 are tightened into causing the clamp plate to draw the two sides of the handguard 001 together effectively affixing the handguard to the barrel nut 005.

Figure 5:
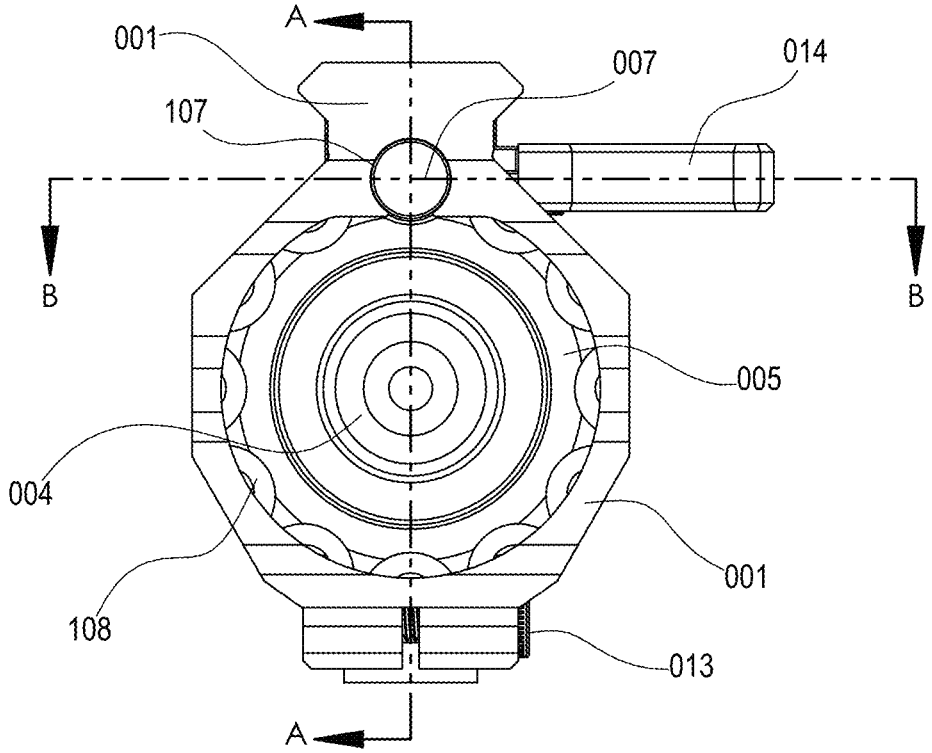
FIG. 5. illustrates a front view looking rearward of the side-mounted forward charging system, depicting clearances in the barrel nut for the charging rod, according to some embodiments.
Figure 6:
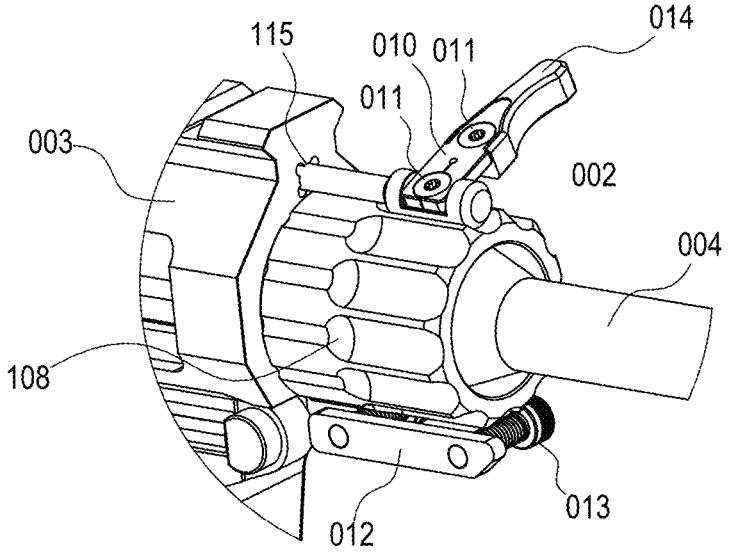
FIG. 6. illustrates a right side perspective cutaway view of the side-mounted forward charging system according to some embodiments.

In some embodiments, FIG. 5 and FIG. 6 illustrate a front view and perspective view respectively of the firearm including the handguard 001, charging handle knob 014, and charging rod 002. Once the charging handle knob 014 is moved to the end of the travel slot 114 in the handguard 001, the bolt will be moved into the complete open breech position and the user now has two options. The charging handle knob 014 can be released, resulting in it being rapidly pushed back to the bolt closed position by a buffer spring, and loading a round into the chamber if a loaded magazine is inserted into the magazine well, effectively loading the firearm. Additionally, the user can rotate the charging handle knob 014 upwards into the retention notch, and then release the charging handle knob 014.

Figure 12:
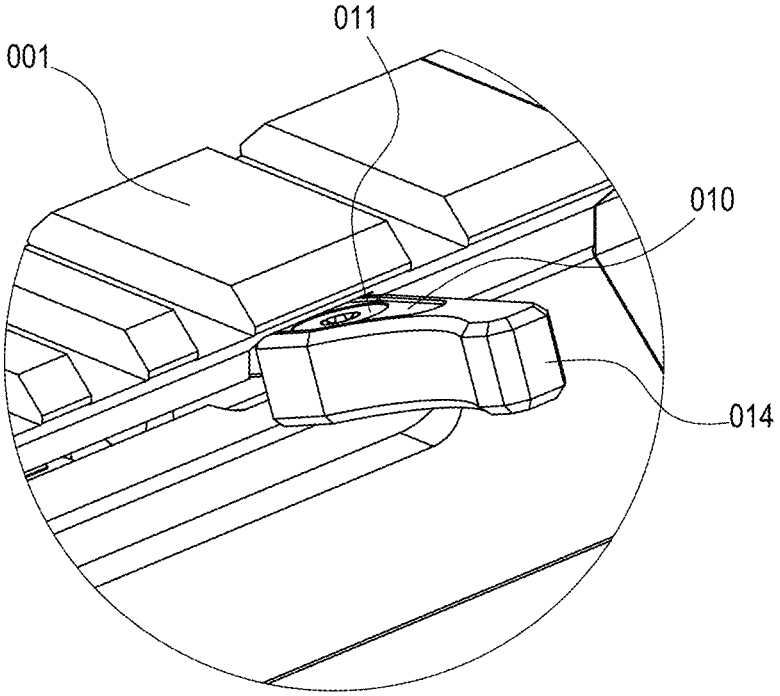
FIG. 12. illustrates a left side detail perspective view depicting the rotational bolt lock engagement between the charging handle and handguard according to some embodiments.
Figure 13:
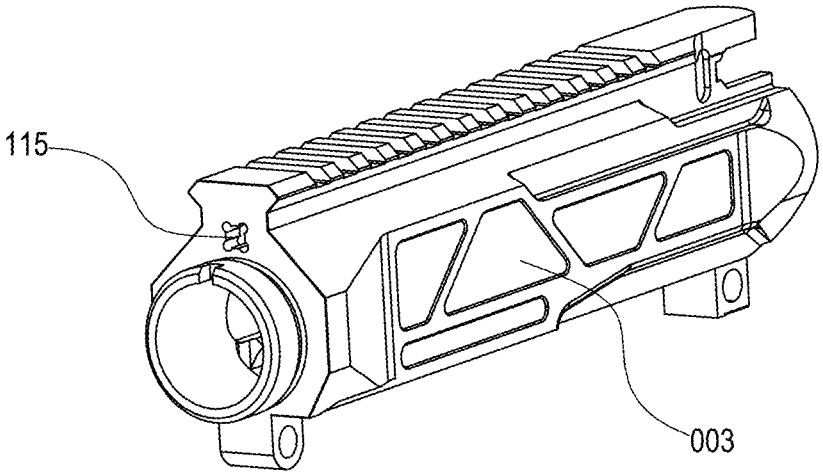
FIG. 13. illustrates a left-side perspective view depicting the gas tube hole in the upper receiver according to some embodiments.
Figure 14:
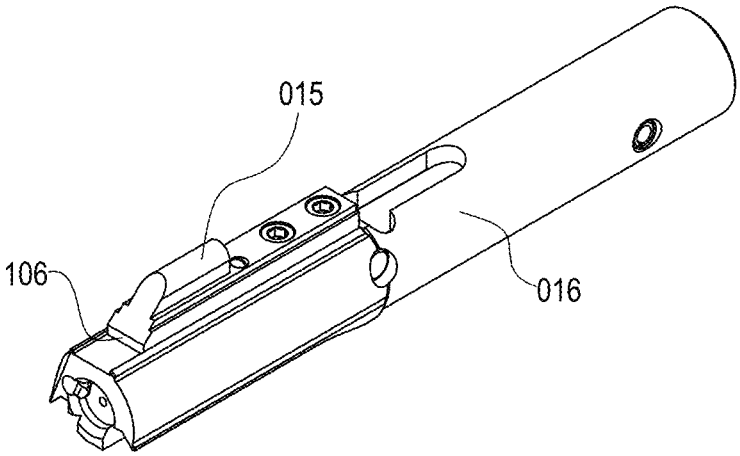
FIG. 14. illustrates a left-side perspective view depicting the bolt carrier according to some embodiments.
Figure 15:
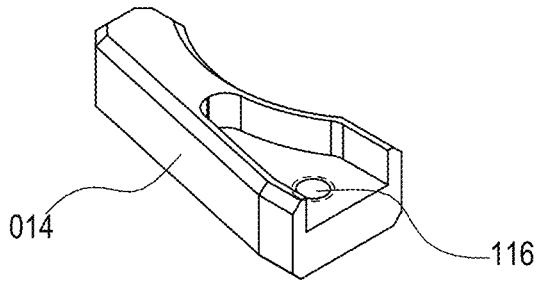
FIG. 15. illustrates a perspective view depicting the charging handle knob according to some embodiments.
Figure 16:
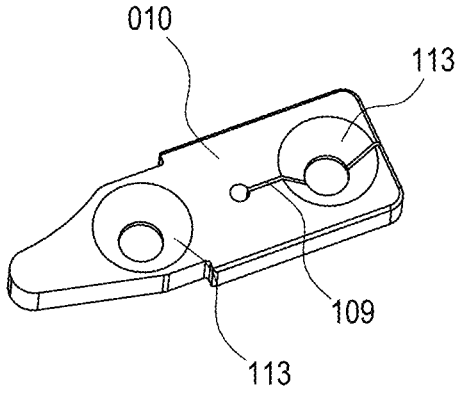
FIG. 16. illustrates a perspective view depicting the charging handle mount plate according to some embodiments.
Figure 17:
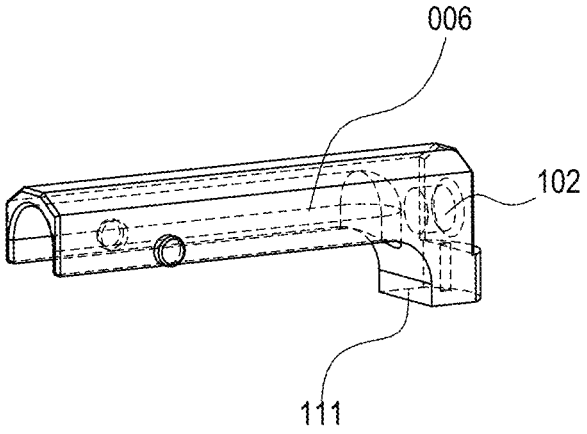
FIG. 17. illustrates a right-side perspective view depicting the charging catch according to some embodiments.
Figure 18:
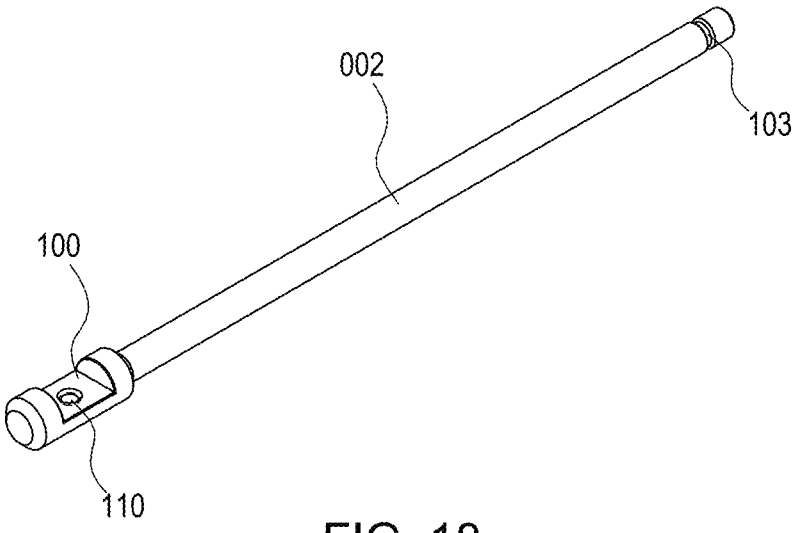
FIG. 18. illustrates a left-side perspective view depicting the charging rod according to some embodiments.
Figure 19:
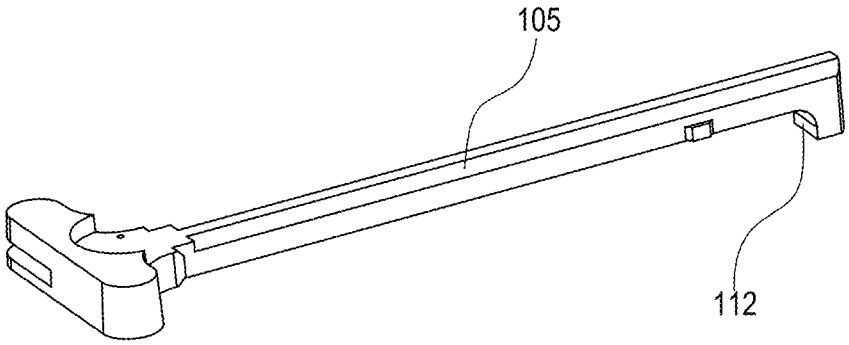
FIG. 19. illustrates a right-side perspective view depicting the charging handle according to some embodiments.
Figure 20:
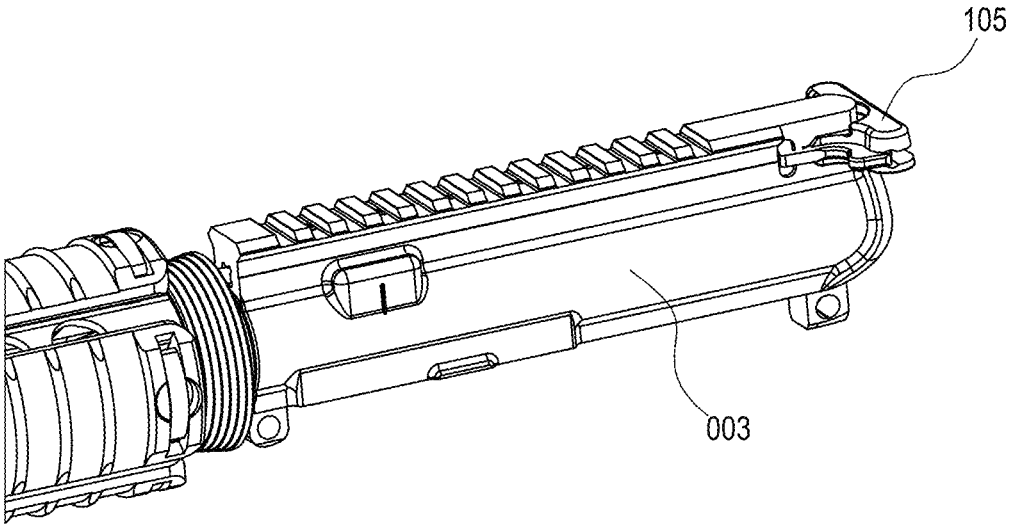
FIG. 20. illustrates a left-side detail perspective view depicting the traditional arrangement of an upper receiver assembly and rear charging handle according to some embodiments.

Alternatively with the charging handle knob 014 (as shown in FIG. 3 and FIG. 12) in the rear most position, the user can engage the factory bolt catch to the upward position and relieve tension from the charging handle knob 4 against the factory bolt catch, resulting in the bolt holding open in the traditional fashion.

In some embodiments, as shown in FIG. 3 and FIG. 12 illustrates the firearm in the bolt rearward, open position. To cycle the firearm to the breech closed position there are generally two different methods. In method 1 a user may grasp the charging handle knob 014 and draw tension off the retention notch in the handguard 001 and then in a controlled fashion rotate the charging handle knob 014 down and slowly allow it to move forward under the user's control which allows the bolt carrier 016 to move forward, until it has reached the closed bolt position and a buffer spring is pressing the bolt carrier 016 against the breech. If a loaded magazine is inserted into the magazine well this will also result in a round being loaded into the chamber. This allows the user a controlled means to check the function of the firearm and diagnose malfunctions or jams.

Alternatively, in a second method, the user can simply use a downward motion of their hand to "slap" the charging handle knob 014 and subsequently the charging handle mount plate 010 out of engagement with the retention notch 104 in the handguard 001 sending the bolt carrier 016 forward into battery by the force of the buffer spring. A flathead screw 011 attaches the charging handle mount plate 010 the charging rod 002 and thus allows the charging handle knob 014 to pivot via the charging rod 002.

Figure 7:
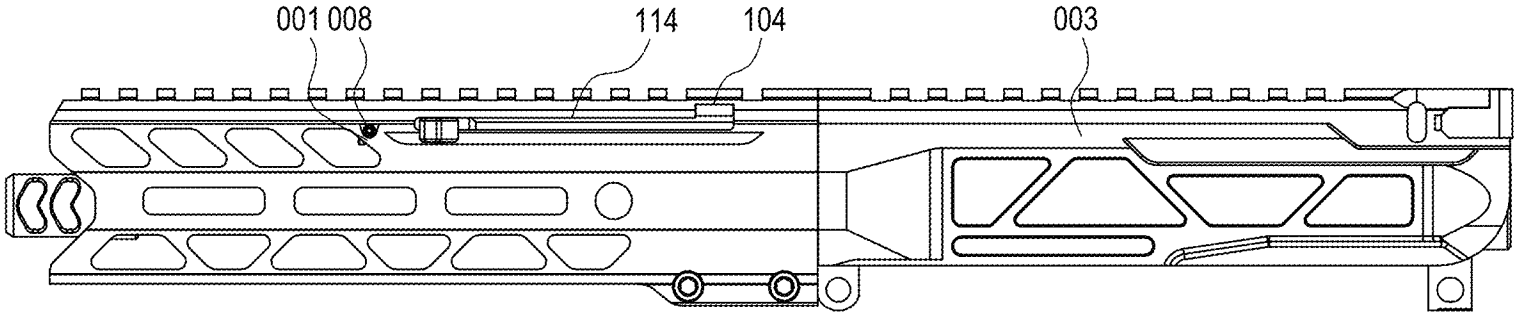
FIG. 7. illustrates a left side view of the side-mounted forward charging system shown in the forward, bolt closed position, according to some embodiments.

FIG. 7. illustrates a left side view of the side-mounted forward charging system shown in the forward, bolt closed position, according to some embodiments. The magnetic catch retainer screw 008 is shown. The magnetic catch retainer screw is threaded into the side of the Handguard 001 and intersects the cylindrical guide channel. It is tightened into the groove in the outside diameter of the magnetic catch housing 007 to retain it in position.

Figure 8:
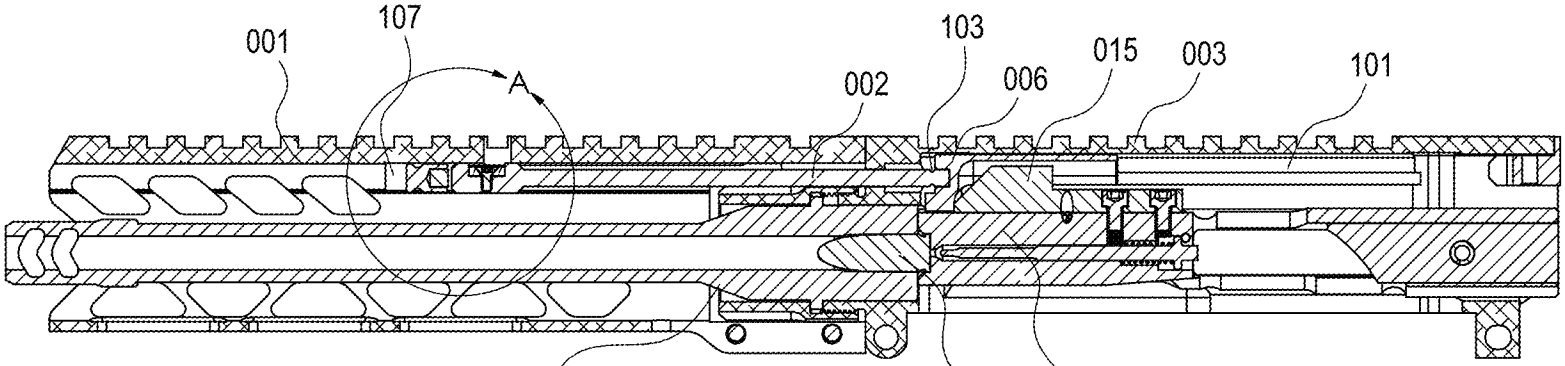
FIG. 8. illustrates a left side section view of the side-mounted forward charging system shown in the forward, bolt closed position, according to some embodiments.

FIG. 8. illustrates a left side section view of the side-mounted forward charging system shown in the forward, bolt closed position, according to some embodiments. FIG. 8 illustrates the positions and interactions of various components of the invention including the charging rod 002, the charging catch 006, and the bolt carrier 016.

Figure 9:
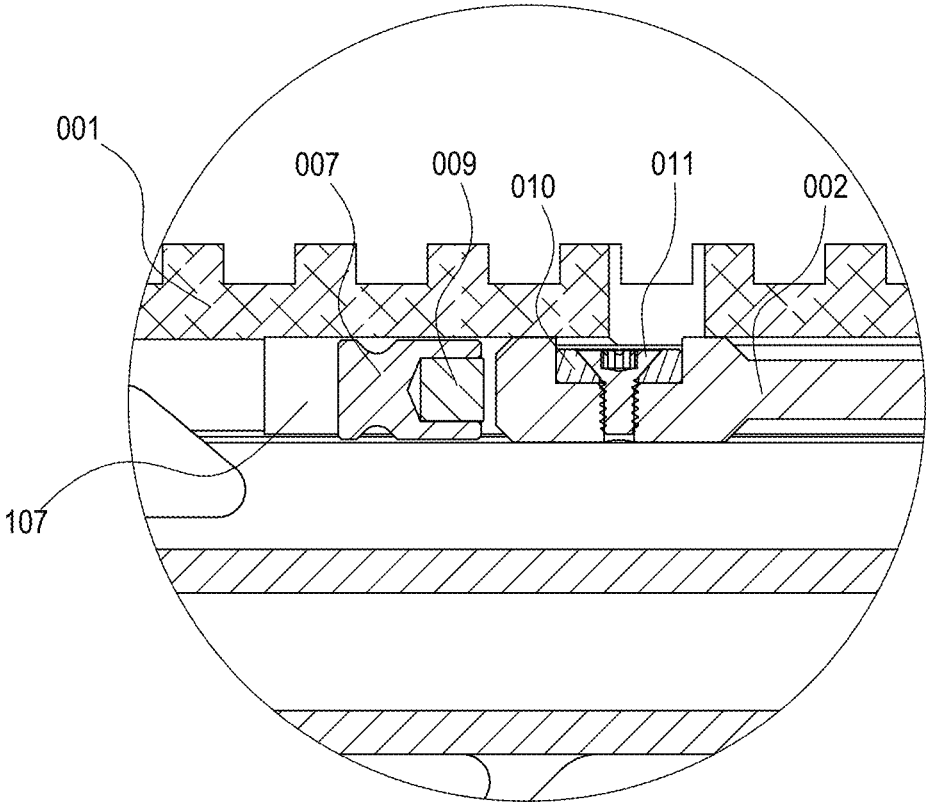
FIG. 9. illustrates a left side section detail view of the forward retention unit and charging system according to some embodiments.

FIG. 9. illustrates a left side section detail view of the magnetic forward retention unit and charging system according to some embodiments. The magnetic catch housing 007 holds the magnetic catch magnet 009 by a press fit. When the charging rod is in the forward position it is drawn against the magnetic forward retention via magnetic forces and is held in place while the rifle cycles. The user can easily break the light tension of the magnet to draw the charging system back and cycle the firearm.

Figure 10:
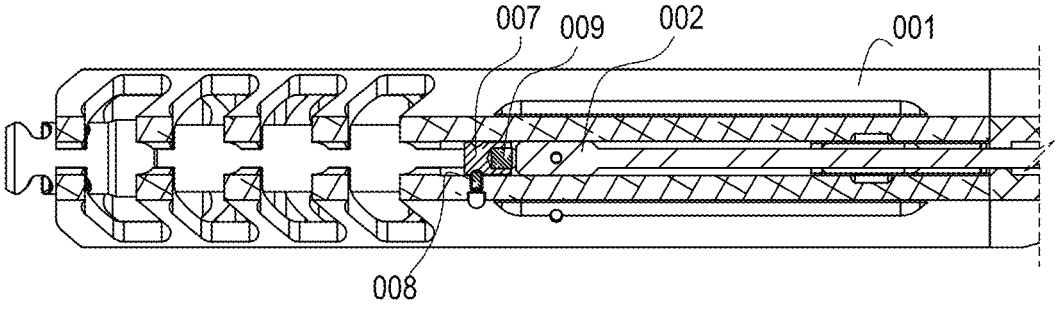
FIG. 10. illustrates a top side cutaway detail view of the forward retention unit and charging system according to some embodiments.

FIG. 10. illustrates a top side cutaway detail view of the forward retention unit and charging system according to some embodiments. The magnetic catch retainer screw 008 is shown tightened into the outer groove of the magnetic catch housing 007 holding it in place in the cylindrical guide channel. Also shown is the guide rod 002 held in the forward position and drawn against the Magnetic catch magnet 009 to prevent the charging system from reciprocating while firing. This prevents possible pinch points of the operators hands as well as potential interference in the cycling of the firearm.

Figure 11:
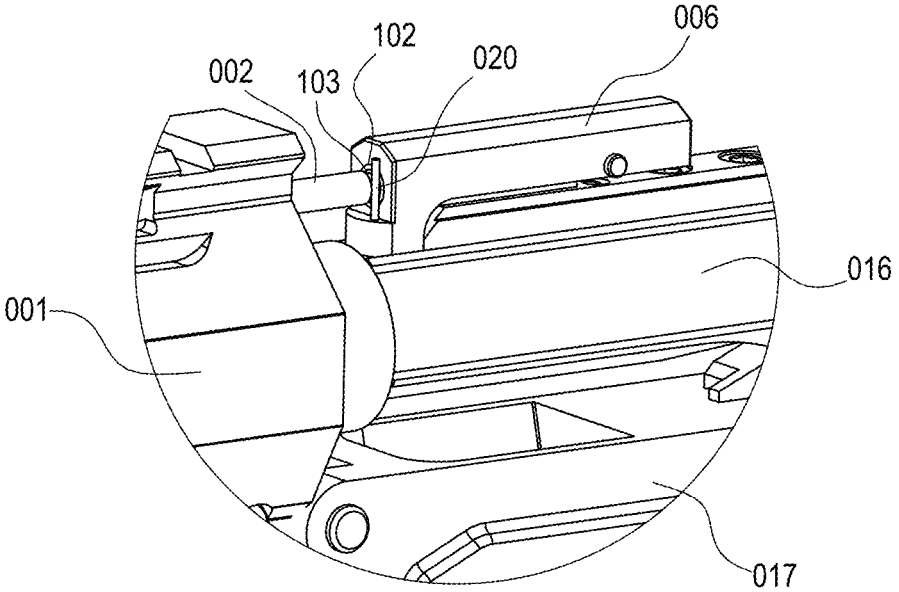
FIG. 11. illustrates a left side cutaway detail perspective view according to some embodiments.

FIG. 11. illustrates a left side detail perspective view according to some embodiments. In some embodiments a rearward "V" groove 103 is found on the minor diameter of the charging rod 002 and engages with the charging catch retainer 020. The charging catch retainer 020 is a spring loaded wire form which is captured in the charging catch 006 and intersects the hole that the charging rod 002 inserts into. When the charging rod 002 is inserted in the hole in the charging catch 006 the charging catch retainer 020 is temporarily pushed out of the way by the charging rod 002 until it has slid in far enough to align the charging catch retainer 020 with the rearward "V" groove 103 at which point the spring pressure pushes the charging rod retainer 020 wire form into the "V" groove 103 capturing the charging catch 006 on the charging rod 002.

FIG. 12. illustrates a left side detail perspective view depicting the rotational bolt lock and illustrates the charging handle assembly rotated into the bolt lock position with the charging handle mount plate 010 engages against the bolt lock notch in the handguard 001.

Method of application of an embodiment of a side-mounted forward charging 375 system for a firearm.

A version of side-mounted forward charging system for a firearm is used with a firearm by first gathering the components: (1) a handguard 001, (2) a charging rod 002, (3) a charging catch 006, (4) a barrel nut 005, (5) a forward retention unit. A user then attaches the components to the firearm by removing the existing handguard. Once the handguard and barrel nut are removed the user will insert the large diameter end of the charging rod into the guide channel from the rear of the handguard 001. Once the charging rod 002 is inserted the user will align the charging rod groove 100 with the slot in the handguard 001 and slide the charging handle mount plate 010, with charging handle knob 014 attached, into the charging rod groove 100. The flat head screw 011 is inserted through the hole in the top of the handguard 001 and tightened into place. Now the barrel nut 005 of the forward side charging system is slid over the barrel and tightened on the upper receiver. Next the handguard 001 is slid over barrel nut 005 and the charging rod 002 is passed through the gas tube hole. Once the handguard 001 is aligned the clamping bolts 013 are tightened. Finally the charging catch 006 is dropped into the charging handle groove and slid forward until the charging rod clips into the bore of the charging catch.

Versions of a side-mounted forward charging system for a firearm may be made individually, in batches, or via continuous assembly.

For example, to make an embodiment of a version of a side-mounted forward charging system for a firearm prepare an appropriate work surface and assemble all the components disclosed herein. Assemble the components in a logical order as someone skilled in the art would do. (1) Start with an aluminum extrusion for the handguard 001. The extrusion will contain a cylindrical guide channel. Cut the extrusion to the appropriate length and machine the extrusion as desired. (2) Next create a charging rod 002. Start with a round steel rod. Cut the rod to the appropriate length and machine to the appropriate dimensions in a lathe as someone skilled in the art would. (3) Make a charging catch 006. Start with an aluminum block and cut to the appropriate length, machine the block as desired to create the charging catch as someone skilled in the art would. (4) To make a barrel nut 005, start with a round aluminum bar. Cut the bar to the appropriate length and machine to the appropriate dimensions in a lathe as someone skilled in the art would. (5) To make a forward retention unit start with a round aluminum rod. Cut the rod to the appropriate length and machine to the appropriate dimensions in a lathe as someone skilled in the art would. Press magnet into bore using an arbor press. Gather and assemble to components for attachment as a possible embodiment.

Different features, variations, and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

The embodiments of a side-mounted forward charging system for a firearm may be utilized individually, concurrently, or in any sequential combination.

Those skilled in the art to which this application relates will appreciate that other and further additions, deletions, substitutions and modifications may be made to the described embodiments.

The specification is not to be taken in a limiting sense, but is made merely for the purpose of describing the general principles of exemplary embodiments; many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

The invention is described with such embodiments, but the invention is not limited to any embodiment. The scope of the invention is limited only by the claims and the invention encompasses numerous alternatives, modifications and equivalents. Several specific details are set forth in the description to provide a thorough understanding of the invention. These details are provided for the purpose of example and the invention may be practiced according to the claims without some or all of these specific details. In general, the order of the steps of disclosed processes may be altered within the scope of the invention.

Unless otherwise indicated, the drawings are intended to be read (e.g., arrangement of parts, proportion, degree, etc.) together with the specifications, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The terms "a" or "an" entity refers to one or more of that entity. As such, the terms "a" (or "an"), "one or more" and "at least one" can be used interchangeably herein.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure. Any alterations and further modifications in the illustrated apparatuses, and such further application of the principles of the invention as illustrated herein are contemplated as would normally occur to one skilled in the art to which the invention relates.

What is claimed is:

1. A side-mounted forward charging system for a non-gas operated firearm, the system comprising:

a handguard of a given length and diameter;

wherein the handguard has a cylindrical bearing guide of a given diameter;

a barrel nut of a given length and diameter;

a charging rod of a given length and diameter;

a charging catch;

a charging handle mount plate;

a charging knob attached to the charging handle mount plate;

wherein the charging catch replaces a standard rear charging handle of the non-gas operated firearm for the charging rod to cycle the non-gas operated firearm without the need for a user to remove the non-gas operated firearm from their shoulder;

a flat head screw for attaching the charging handle mount plate to the charging rod;

a countersunk screw hole in the charging handle mount plate bisected by a slot;

wherein the charging rod has a slot perpendicular to a longitudinal axis thereof, with a threaded hole therein;

wherein the charging handle mount plate is inserted into the charging rod slot;

wherein the flat head screw is inserted into the countersunk screw hole and tightened; and wherein the tightening of the flat head screw causes the charging handle mount plate to expand in the charging rod slot.

2. The side-mounted forward charging system of claim 1 further comprising an upper receiver as part of the non-gas operated firearm, wherein the barrel nut is threaded over threads of the upper receiver and the barrel nut has a plurality of grooves to allow clearance of the charging rod.

3. The side-mounted forward charging system of claim 1 wherein the handguard has a travel slot in which the charging handle mount plate slides forward and backwards;

wherein a rear of the travel slot has a retention notch to allow the charging handle mount plate to rotate into and hold a bolt carrier in the non-gas operated firearm in a locked open position.

4. The side-mounted forward charging system of claim 1 further comprising:

a plurality of clamp screws; and a clamp nut plate onto which the clamp screws are tightened to secure the handguard onto the barrel nut.

5. The side-mounted forward charging system of claim 1 further comprising:

a charging handle slot in an upper receiver of the non-gas operated firearm;

a bore on the charging catch into which the charging rod slides; and a charging catch retainer securely clipping into a groove on the charging rod.

6. The side-mounted forward charging system of claim 1 wherein the barrel nut comprises a plurality of grooves to allow clearance of the charging rod.

7. The side-mounted forward charging system of claim 1 further comprising:

wherein the charging rod is a cylindrical rod having a first portion and a second portion;

wherein the first portion travels through the cylindrical bearing guide of the handguard; and wherein the second portion travels through a gas tube hole of an upper receiver of the non-gas operated firearm.

8. A method of using a side-mounted forward charging system, the method comprising:

selecting a firearm to use with the side-mounted forward charging system;

assembling components of the side-mounted forward charging system comprising: a handguard of a given length and diameter; wherein the handguard has a cylindrical bearing guide of a given diameter; a barrel nut of a given length and diameter; a charging rod of a given length and diameter; a charging catch; a charging handle mount plate; and a charging knob attached to the charging handle mount plate;

removing a conventional rear charging handle from the firearm;

inserting the charging rod into the handguard;

installing the handguard onto the barrel nut;

attaching the charging handle mount plate and charging handle knob to the charging rod via a threaded hole;

sliding the charging rod through an upper receiver of the firearm and engaging the charging rod with the charging catch via a bore and a V-shaped groove;

securing the handguard onto the barrel nut with clamping screws to hold the handguard in place;

attaching the charging handle mount plate to the charging rod via a flat head screw;

bisecting a countersunk screw hole in the charging handle mount plate by a slot, wherein the charging rod has a slot perpendicular to a longitudinal axis thereof, with the threaded hole therein;

inserting the charging handle mount plate into the charging rod slot; and inserting and tightening the flat head screw into the countersunk screw hole;

wherein the tightening of the flat head screw causes the charging handle mount plate to expand in the charging rod slot.

9. The method of claim 8 wherein the charging catch permits the charging rod to cycle a bolt carrier without a user having to remove the firearm from their shoulder.

* * * * *